US010403960B2

(12) United States Patent
Sultenfuss et al.

(10) Patent No.: US 10,403,960 B2
(45) Date of Patent: Sep. 3, 2019

(54) SYSTEM AND METHOD FOR ANTENNA OPTIMIZATION

(71) Applicant: Dell Products L.P., Round Rock, TX (US)

(72) Inventors: Andrew Thomas Sultenfuss, Leander, TX (US); Mitchell Anthony Markow, Hutto, TX (US); Kevin J. McCann, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 173 days.

(21) Appl. No.: 15/087,414

(22) Filed: Mar. 31, 2016

(65) Prior Publication Data

US 2017/0288295 A1 Oct. 5, 2017

(51) Int. Cl.
*H01Q 1/22* (2006.01)
*H01Q 21/00* (2006.01)

(52) U.S. Cl.
CPC ..... *H01Q 1/2266* (2013.01); *H01Q 21/00* (2013.01)

(58) Field of Classification Search
USPC ..... 455/575.7
See application file for complete search history.

(56) References Cited

U.S. PATENT DOCUMENTS 5,893,033 A * 4/1999 Keskitalo ..... H04W 36/32 455/437
8,159,399 B2 * 4/2012 Dorsey ..... H01Q 1/2266 343/702
8,228,233 B2 7/2012 Montag et al.
8,543,160 B2 * 9/2013 Hung ..... H01Q 21/28 455/556.1
8,619,907 B2 * 12/2013 Mujtaba ..... H04B 7/0684 370/334
8,694,063 B2 * 4/2014 Hung ..... H01Q 21/28 455/562.1
2007/0140371 A1 * 6/2007 Horng ..... H04L 1/0625 375/267
2007/0274253 A1 * 11/2007 Zhang ..... H04B 7/0697 370/328
2008/0248753 A1 * 10/2008 Chang ..... H04B 7/0417 455/63.1

(Continued)

*Primary Examiner* — Lana N Le

(74) *Attorney, Agent, or Firm* — Baker Botts L.L.P.

(57) ABSTRACT

Systems and methods are disclosed for antenna optimization in an information handling system. A portable information handling system includes a chassis and a plurality of antennas coupled to the chassis. The plurality of antennas is capable of communicating in a multiple-input and multiple-output (MIMO) antenna configuration with a wireless-enabled device. The system includes an antenna control module communicatively coupled to the plurality of antennas. The antenna control module is configured to detect a change in at least one of a physical configuration of the chassis and an environment surrounding the portable information handling system, the change affecting a performance one or more of the plurality of antennas. The antenna control module is also configured to, based on the change, update a MIMO antenna list from the plurality of antennas. The MIMO antenna list represents active antennas for communicating with the wireless-enabled device.

30 Claims, 5 Drawing Sheets

(56) References Cited

U.S. PATENT DOCUMENTS

| | | | | |
|---|---|---|---|---|
| 2009/0146796 | A1* | 6/2009 | Goto | H04B 5/02 340/10.51 |
| 2009/0232337 | A1* | 9/2009 | Tang | H04R 25/554 381/312 |
| 2010/0167672 | A1* | 7/2010 | Ahn | H01Q 1/243 455/132 |
| 2013/0002487 | A1* | 1/2013 | Hosoya | H04B 7/0617 342/372 |
| 2014/0203966 | A1* | 7/2014 | Sultenfuss | H01Q 1/2266 342/368 |
| 2014/0269642 | A1* | 9/2014 | Forenza | H04J 11/003 370/337 |
| 2014/0323063 | A1* | 10/2014 | Xu | H01Q 1/243 455/77 |
| 2015/0326264 | A1* | 11/2015 | Nilsson | G06F 1/1698 455/575.7 |
| 2018/0074168 | A1* | 3/2018 | Subburaj | G01S 7/292 |

* cited by examiner

SYSTEM AND METHOD FOR ANTENNA OPTIMIZATION

TECHNICAL FIELD

This disclosure relates generally to information handling systems and, more particularly, to a system and method for antenna optimization in an information handling system.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Examples of information handling systems include portable information handling systems, such as, smart phones, tablet computers, notebook computers, media players, digital cameras, 2-in-1 tablet-laptop combination computers, wireless organizers, and/or combinations thereof. A portable information handling system may generally be any device that a user may carry for handheld use and that includes a processor. These systems may communicate across wireless networks information, such as voice, images, text, video, and data. A portable information handling system may rely on one or more antennas to communicate such information wirelessly. These antennas may be affected by the configuration of and the environment around the portable information handling system which may change as a user uses, configures, and/or moves the system. Thus, management of antennas within the information handling system may be necessary.

SUMMARY

In some embodiments, a portable information handling system is disclosed that includes a chassis and a plurality of antennas coupled to the chassis, the plurality of antennas capable of communicating in a multiple-input and multiple-output (MIMO) antenna configuration with a wireless-enabled device. The system further includes an antenna control module communicatively coupled to the plurality of antennas. The antenna control module is configured detect a change in at least one of a physical configuration of the chassis and an environment surrounding the portable information handling system, the change affecting a performance one or more of the plurality of antennas. The antenna control module is also configured to, based on the change, update a MIMO antenna list from the plurality of antennas. The MIMO antenna list represents active antennas for communicating with the wireless-enabled device In another embodiment, a method is disclosed that includes detecting a change in at least one of a physical configuration of a chassis of a portable information handling system and an environment surrounding the portable information handling system. The change affecting a performance one or more of the plurality of antennas capable of communicating in a multiple-input and multiple-output (MIMO) antenna configuration with a wireless-enabled device. The method also includes, based on the change, updating a MIMO antenna list from the plurality of antennas. The MIMO antenna list represents active antennas for communicating with the wireless-enabled device.

In a further embodiment, non-transitory computer-readable medium is disclosed that stores instructions that, when executed by a processor, cause a processor to detect a change in at least one of a physical configuration of the chassis and an environment surrounding a portable information handling system. The change affecting a performance one or more of the plurality of antennas capable of communicating in a multiple-input and multiple-output (MIMO) antenna configuration with a wireless-enabled device. The processor is further caused to, based on the change, update a MIMO antenna list from the plurality of antennas. The MIMO antenna list represents active antennas for communicating with the wireless-enabled device.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION

Figure 1:
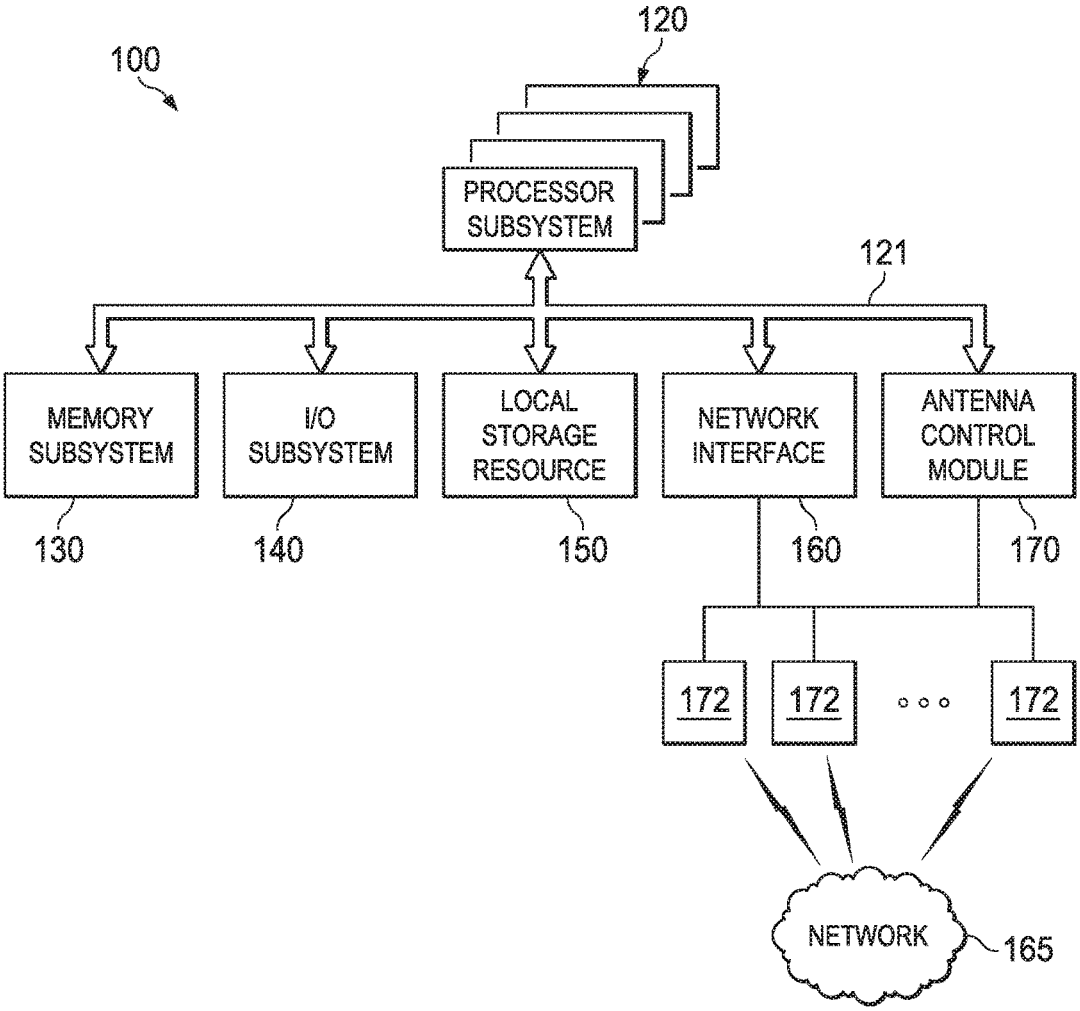
FIG. 1 is a block diagram of selected elements of an embodiment of a portable information handling system.

In the following description, details are set forth by way of example to facilitate discussion of the disclosed subject matter. It should be apparent to a person of ordinary skill in the field, however, that the disclosed embodiments are exemplary and not exhaustive of all possible embodiments.

As used herein, a hyphenated form of a reference numeral refers to a specific instance of an element and the unhyphenated form of the reference numeral refers to the collective or generic element. Thus, for example, widget "72-1" refers to an instance of a widget class, which may be referred to collectively as widgets "72" and any one of which may be referred to generically as a widget "72."

As noted previously, many information handling systems or groups of information handling systems may be configured as portable information handling systems that utilize wireless communications to transmit and receive information. To transmit and receive information wirelessly, portable information handling systems may use one or more antennas. In some embodiments, antennas of the information handling system may be configured to communicate with another wireless-enabled device, such as a network access point, using a Multiple Input Multiple Output (MIMO) antenna configuration. That is, one or more antennas of the portable information handling system may communicate with one or more transmitters of the other wireless-enabled device. Utilizing multiple antennas may increase the reliability and/or bandwidth of communications of the portable information handling system.

Despite having a plurality of antennas, a portable information handling system may not use all of its antennas at all times. For example, a portable information handling may enter into a particular configuration, such as a low power or low data usage configuration, in which case it may be desirable to adjust which of the plurality of antennas are active or inactive. An antenna in an active state may indicate that the antenna is being used to receive and/or transmit wireless signals including information, such as, voice, images, text, video, data, and/or other information. An antenna in an inactive state may indicate that the antenna is in a passive state, consuming and emitting less energy than in an active state—often times substantially no or negligible energy. As another example, the physical configuration of the chassis of the portable information handling system or the environment surrounding the portable information handling system may affect one or more antennas in which case it may be desirable to adjust the antenna configuration. In this manner, a portable information handling system may monitor various aspects of the system to determine when and if changes to the antenna configuration are desirable.

For the purposes of this disclosure, an information handling system may include an instrumentality or aggregate of instrumentalities operable to compute, classify, process, transmit, receive, retrieve, originate, switch, store, display, manifest, detect, record, reproduce, handle, or utilize various forms of information, intelligence, or data for business, scientific, control, entertainment, or other purposes. For example, an information handling system may be a server, a personal computer, a PDA, a consumer electronic device, a network storage device, or another suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communication between the various hardware components.

Figure 3:
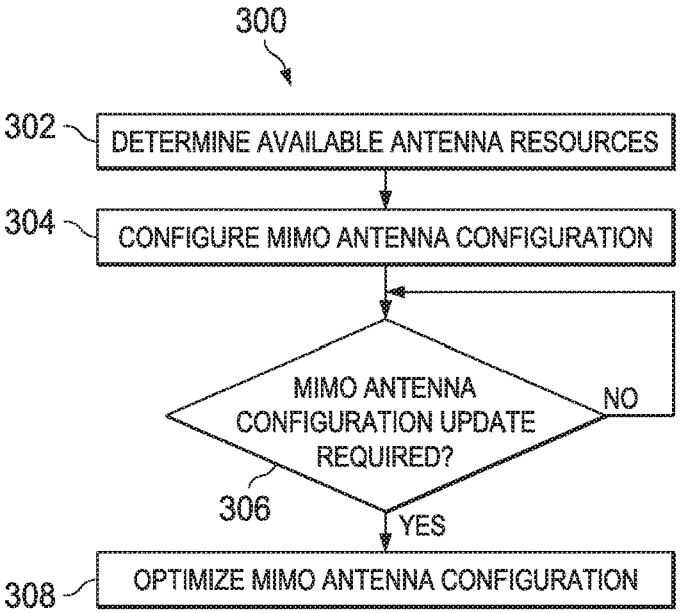
FIG. 3 illustrates a flowchart depicting selected elements of an embodiment of a method for antenna optimization in accordance with some embodiments of the present disclosure.

Particular embodiments are best understood by reference to FIGS. 1-3 wherein like numbers are used to indicate like and corresponding parts.

FIG. 1 illustrates a block diagram of selected elements of an embodiment of a portable information handling system 100 in accordance with some embodiments of the present disclosure. In various embodiments, portable information handling system 100 may represent different types of portable information handling systems, such as, smart phones, tablet computers, notebook computers, media players, digital cameras, 2-in-1 tablet-laptop combination computers, and wireless organizers. In some embodiments, portable information handling system 100 may include a chassis or outer structural framework (not shown) that houses one or more components of the information handling system. In various embodiments, portable information handling system 100 may be operated by the user using a keyboard, mouse, or touch panel (not shown). Components of portable information handling system 100 may include, but are not limited to, processor subsystem 120, which may comprise one or more processors, and system bus 121 that communicatively couples various system components to processor subsystem 120 including, for example, memory subsystem 130, I/O subsystem 140, local storage resource 150, network interface 160, and antenna control module 170. External or remote elements, such as network 165, are also shown to give context to an environment in which portable information handling system 100 may be configured to operate.

Processor subsystem 120 may comprise a system, device, or apparatus operable to interpret and/or execute program instructions and/or process data, and may include a microprocessor, microcontroller, digital signal processor (DSP), application specific integrated circuit (ASIC), or another digital or analog circuitry configured to interpret and/or execute program instructions and/or process data. In some embodiments, processor subsystem 120 may interpret and/or execute program instructions and/or process data stored locally (e.g., in memory subsystem 130). In the same or alternative embodiments, processor subsystem 120 may interpret and/or execute program instructions and/or process data stored remotely (e.g., in a network storage resource, not shown).

System bus 121 may represent a variety of suitable types of bus structures, including for example, a memory bus, a peripheral bus, or a local bus using various bus architectures in selected embodiments. For example, such architectures may include, but are not limited to, Micro Channel Architecture (MCA) bus, Industry Standard Architecture (ISA) bus, Enhanced ISA (EISA) bus, PCI bus, PCI-E bus, HyperTransport (HT) bus, Integrated Interchip Sound (IIS) bus, Serial Peripheral Interface (SPI) bus, and Video Electronics Standards Association (VESA) local bus, among others. Although illustrated as a single bus in FIG. 1, system bus 121 may be implemented as a combination of one or more suitable busses, and in some embodiments, various components may use one or more different busses to communicate with other components of portable information handling system 100.

Memory subsystem 130 may comprise a system, device, or apparatus operable to retain and/or retrieve program instructions and/or data for a period of time (e.g., computer-readable media). Memory subsystem 130 may comprise random access memory (RAM), electrically erasable programmable read-only memory (EEPROM), a PCMCIA card, flash memory, magnetic storage, opto-magnetic storage, and/or a suitable selection and/or array of volatile or non-volatile memory that retains data after power to its associated information handling system, such as portable information handling system 100, is powered down.

In portable information handling system 100, I/O subsystem 140 may comprise a system, device, or apparatus generally operable to receive and/or transmit data to/from/within portable information handling system 100. I/O subsystem 140 may represent, for example, a variety of communication interfaces, graphics interfaces, video interfaces, user input interfaces, and/or peripheral interfaces. For example, I/O subsystem 140 may comprise a touch panel and display adapter. The touch panel (not shown) may include circuitry for enabling touch functionality in conjunction with a display (not shown) that is driven by display adapter (not shown).

Local storage resource 150 may comprise computer-readable media (e.g., hard disk drive, floppy disk drive, CD-ROM, and/or other type of rotating storage media, flash memory, EEPROM, and/or another type of solid state storage media) and may be generally operable to store instructions and/or data. For example, local storage resource 150 may store executable code in the form of program files that may be loaded into memory 130 for execution. In addition to local storage resources 150, in some embodiments, portable information handling system 100 may communicatively couple via network 165 to a network storage resource (not shown) using network interface 160 discussed below.

Network interface 160 may be a suitable system, apparatus, or device operable to serve as an interface between portable information handling system 100 and network 165. Network interface 160 may enable portable information handling system 100 to communicate over network 165 using any suitable transmission protocol and/or standard, including, but not limited to various transmission protocols and/or standards. Network 165 coupled to network interface 160 may be implemented as, or may be a part of, a storage area network (SAN), personal area network (PAN), local area network (LAN), a metropolitan area network (MAN), a wide area network (WAN), a wireless local area network (WLAN), a virtual private network (VPN), an intranet, the Internet or another appropriate architecture or system that facilitates the communication of signals, data and/or messages (generally referred to as data or information). In some embodiments, network 165 communicatively coupled to network interface 160 may transmit data using a desired storage and/or communication protocol, including, but not limited to, Fibre Channel, Frame Relay, Asynchronous Transfer Mode (ATM), Internet protocol (IP), other packet-based protocol, small computer system interface (SCSI), Internet SCSI (iSCSI), Serial Attached SCSI (SAS) or another transport that operates with the SCSI protocol, advanced technology attachment (ATA), serial ATA (SATA), advanced technology attachment packet interface (ATAPI), serial storage architecture (SSA), integrated drive electronics (IDE), and/or any combination thereof. Network 165, network interface 160, and/or various components associated therewith may be implemented using hardware, software, or any combination thereof. Network interface 160 may enable wired and/or wireless communications to and/or from portable information handling system 100.

In some embodiments, network interface 160 may enable wireless communication to and/or from portable information handling system 100 using electromagnetic radiation. The electromagnetic radiation may comprise radio waves encoded with data, also referred to as a radio signals. Network interface 160 may send and/or receive radio signals to/from another wireless-enabled device. As an example, network interface 160 may transmit and/or receive radio signals to a network access point associated with network 165, thereby allowing portable information handling system 100 to communicate wirelessly with network 165 and other devices communicatively coupled to network 165.

To transmit and/or receive radio signals, network interface 160 may use one or more antennas 172. Antennas 172 may include any suitable system, apparatus, or device capable of receiving and/or transmitting radio waves, including for example, a monopole antenna, dipole antenna, directional antenna, parabolic antenna, patch antenna, Planar Inverted-F Antenna (PIFA) antenna, slot antenna, microstrip antenna, sector antenna, or another suitable antenna. In some embodiments, portable information handling system 100 may use one or more different types of antennas to communicate with other wireless-enabled devices. Antennas 172 may include any appropriate material, including for example, silver, copper, gold, aluminum, calcium, tungsten, zinc, nickel, iron, mylar, or another material suitable for transmitting and/or receiving radio signals, including a combination of one or more materials. In some embodiments, portable information handling system 100 may use antennas 172 to communicate using one or more wireless communication standards, such as IEEE 802.11n or 802.11ac (Wi-Fi), Evolved High-Speed Packet access (HSPA+, or 3G), Worldwide Interoperability for Microwave Access (WiMAX), and/or Long Term Evolution (4G).

In some embodiments, portable information handling system 100 may also include antenna control module 170. Antenna control module 170 may be a system, device, or apparatus communicatively coupled to antennas 172. Antenna control module may monitor and/or control antennas 172. As discussed above, antennas 172 may enable wireless communication to and/or from portable information handling system 100 via radio signals. However, in some embodiments, it may be desirable to reconfigure, or optimize the configuration of antennas. For example, if portable information handling system 100 enters into a low power or low data usage configuration, it may be desirable to turn one or more antennas to an inactive state. As another example, the physical configuration of the chassis of portable information handling system 100 and/or the environment surrounding the system may affect the reception and/or transmission of one or more antennas 172, such that it may be desirable to adjust the antenna configuration. For example, changed reception of one or more antennas and/or standard absorption rate (SAR) conditions may necessitate updates to the antenna configuration. In practice, the antenna configuration of portable information handling system 100 may be modified to optimize any particular aspect of the system (e.g., communication throughput, communication reliability, power, specific absorption rate).

In order to detect and/or process changes to portable information handling system 100, antenna control module 170 may communicatively couple to one or more other components of portable information handling system 100. For example, antenna control module 170 may communicatively couple to processor subsystem 120, memory subsystem 130, I/O subsystem 140, local storage resource 150, network interface 160, antennas 172, and/or other components not illustrated in FIG. 1, such as sensors (e.g., an accelerometer, proximity sensor, gyroscope, magnetometer, button, switch, and/or any other appropriate sensor). Antenna control module 170 may use system bus 121 or another suitable method for communicating with other components of portable information handling system 100. Thus, antenna control module 170 may be able to monitor various aspects of portable information handling system 100 to detect and determine when and if changes the antenna configuration are desirable. If changes are desirable, antenna control module 170 may make changes to appropriate antennas 172 by for example, turning one or more antennas 172 to an active or inactive state, and/or otherwise optimizing the antenna configuration.

In some embodiments, antenna control module 170 may manage how antennas 172 communicate with other wireless-enabled devices. As discussed earlier, antennas 172 may be arranged in a MIMO configuration such that one or more antennas 172 communicates with one or more transmitters of another wireless-enabled device. In some embodiments, antennas 172 may be arranged in a 1×, 2×2, 3×3, 4×4 or another suitable MIMO configuration. The MIMO configuration may implement spatial multiplexing, diversity multiplexing, and/or other suitable techniques of communication. By using the multiple signal paths between one or more antennas 172 and one or more transmitters, the MIMO configuration may improve signal reception (reliability) and/or capacity (throughput). In some embodiments, antenna control module 170 may maintain a MIMO antenna list, representing antennas 172 available for use in the MIMO configuration. Adding an antenna 172 to the MIMO antenna list may result in that MIMO configuration algorithm considering the particular antenna 172 for communication. By contrast, removing an antenna 172 from the MIMO antenna list may result in that particular antenna 172 not being considered for communication in the MIMO configuration algorithm. Thus, antenna control module 170 may modify the MIMO antenna list to select which antennas 172 are available for use in the MIMO configuration.

Adjustments to the MIMO antenna list may require and/or initiate updates to the MIMO configuration of antennas. For example, removing an antenna 172 from the MIMO antenna list may require that the MIMO configuration be modified to, for example, transition to use another available antenna in the MIMO antenna list or reduce the MIMO configuration (e.g., transition from a 3×3→2×2 MIMO configuration) to account for removed antenna 172. Similarly, adding an antenna 172 to the MIMO antenna list may allow the MIMO configuration to, for example, transition to increase the MIMO configuration (e.g., transition from a 2×2→3×3 MIMO configuration) or otherwise consider whether the newly available antenna 172 should replace another antenna in the current MIMO configuration. In some embodiments, the MIMO algorithm for the communication standard in use may perform updates to the MIMO configuration as necessary in response to updates to the MIMO antenna list by antenna control module 170.

To ensure optimal communication, antenna control module 170 may initiate the "training" or "retraining" of antennas 172 following an update to the MIMO antenna list, a detected change that may affect antennas 172, and/or after the expiration of a predetermined time interval. For example, updating the MIMO antenna list (e.g., by removing or adding an antenna) may alter MIMO pairings between antennas 172 and transmitters in the MIMO configuration. However, not all changes in the configuration of and/or environment near the portable information handling system 100 may result in an update to the MIMO antenna list. Nonetheless, it may be beneficial to retrain one or more antennas 172 in the MIMO configuration to optimize communications to and/from portable information handling system 100. Thus, in some embodiments, antenna control module 170 may retrain antennas in response to a detected change to the configuration of and/or environment near the portable information handling system 100. In certain embodiments, antenna control module 170 may periodically retrain antennas in the MIMO configuration on a predetermined interval (e.g., every 5 minutes) even without updates to the MIMO antenna list to help ensure that the configuration of antennas remains optimized. In some embodiments, the MIMO algorithm for the communication standard in use may perform the antenna training in accordance with the communication standard in response to a request by antenna control module 170.

Retraining antennas may be done in a manner consistent with the particular communications standard being used for communication. In some embodiments, retraining may involve sending and/or receiving data (e.g., training signals or other data) between antennas 172 and transmitters of the wireless-enabled device with which the antennas are "paired" or communicatively coupled. By detecting the strength and/or delay of the data transmitted/received at different antennas 172 and transmitters, the MIMO algorithm may be able to optimize the MIMO configuration (e.g., determine the appropriate number of antennas and transmitters to use, such as 1×1, 2×2, 3×3, or 4×4 MIMO configuration), and the particular settings (e.g., the appropriate signals, delays to apply to the signals, and/or strength of the signals to transmit on the different paths) of the one or more communication paths between the antennas and transmitters.

As noted previously, portable information handling system 100 may be configured to operate in multiple configurations and/or environments. As will be described in further detail below, the present disclosure illustrates optimizing the MIMO antenna configuration based on the configuration of and/or environment surrounding the information handling system.

Figure 2A:
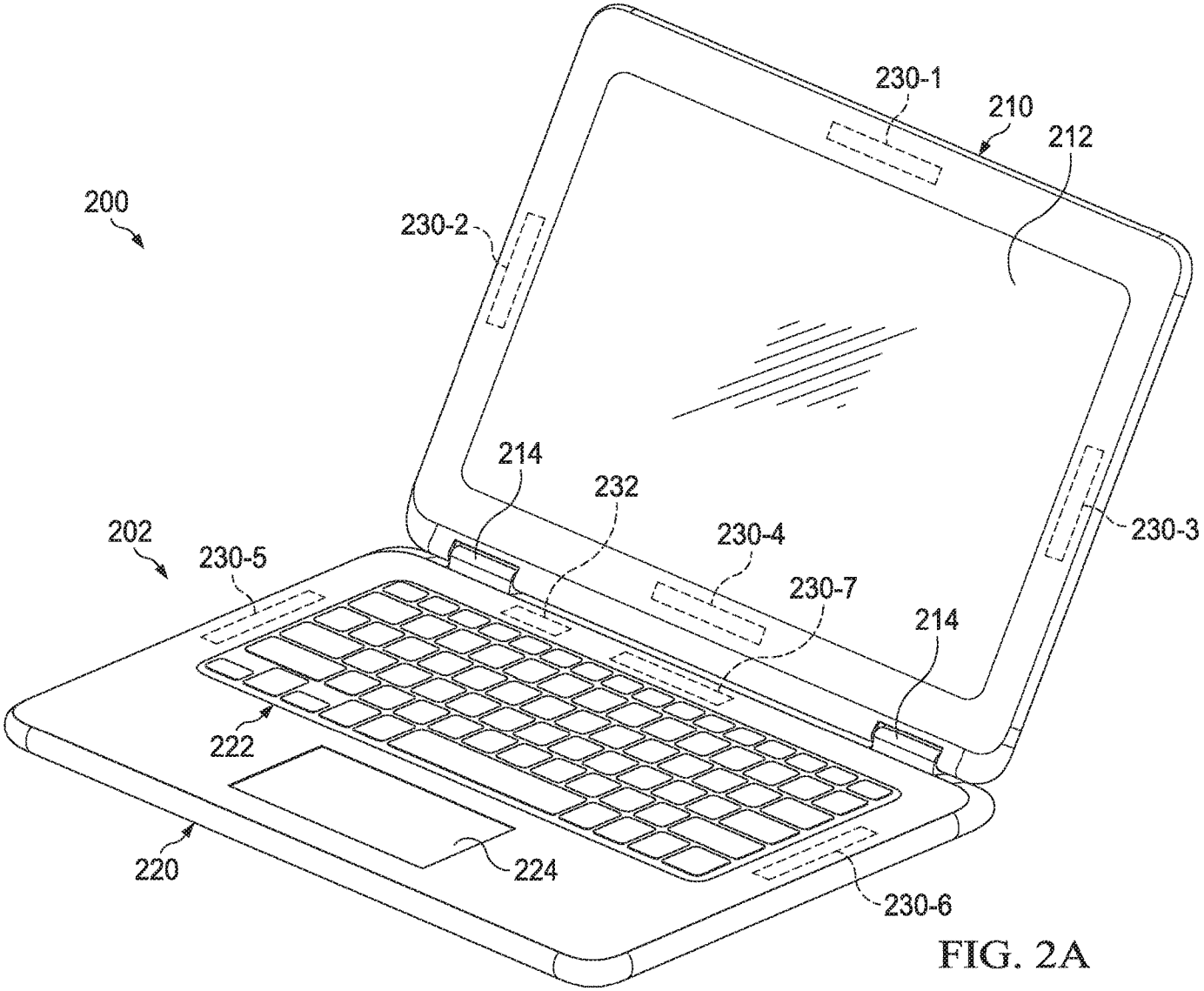
FIG. 2A illustrates a portable information handling system in laptop mode in accordance with some embodiments of the present disclosure.

FIGS. 2A-2D illustrate isometric views of an portable information handling system in various configurations. For example, FIG. 2A illustrates a portable information handling system 200 in laptop mode. Portable information handling system 200 is a 2-in-1 laptop shown with chassis 202, comprising lid 210 coupled to base 220 via hinges 214. In laptop mode, lid 210 and base 220 may be arranged in an open configuration, representing lid 210 partially opened from base 220. In some embodiments, laptop mode may represent lid 210 open between approximately 45 and 135 degrees from base 220. In certain embodiments, laptop mode may represent lid 210 open between approximately 1 and 180 degrees from base 220. A user may provide input to portable information handling system 200 via keyboard 222, mouse trackpad 224, touch panel 212, and/or another I/O component not illustrated. Output from information handling system 200 may be displayed via touch panel 212.

Portable information handling system 200 may include one or more antennas capable of wireless communications. For example, information handling system 200 may include antennas 230-1, 230-2, 230-3, 230-4, 230-5, 230-6, and 230-7. Like antennas 172 discussed with respect to FIG. 1, antennas 230 may be any of a monopole antenna, dipole antenna, directional antenna, parabolic antenna, patch antenna, Planar Inverted-F Antenna (PIFA) antenna, slot antenna, microstrip antenna, sector antenna, or another suitable antenna capable of wireless communication. In some embodiments, antennas 230 may be configured within chassis 202. In certain embodiments, one or more antennas 230 may be configured outside of chassis 202, such as an antenna communicatively coupled to portable information handling system 200 via, for example, a universal serial bus (not shown) or another suitable means.

Antennas 230 may be configured at any location with respect to chassis 202. In some embodiments, antennas 230 may be configured proximate edges or proximate corners of chassis 202. Selection, placement, and orientation of antennas 230 may be made based on desired communication throughput, desired communication reliability, supported communication protocols, type of antenna, power, specific absorption rate, materials comprising portable information handling system 200, possible configurations of portable information handling system 200, costs, and/or any other factor. To illustrate, antennas 230-1, 230-2, 230-3, and 230-4 may be configured within lid 210, while antennas 230-5, 230-6, and 230-7 may be configured within base 220. Although antennas 230-1 through 230-7 are illustrated and discussed with respect to FIGS. 2A-D, any number and/or placement of antennas may be included in embodiments of the present invention.

Portable information handling system 200 may also include antenna control module 232 for monitoring and/or controlling antennas 230. As discussed with respect to FIG. 1, antenna control module 232 may manage how antennas 230 communicate with other wireless devices, such as a network access device of a network (not shown). Antenna control module 232 may arrange and maintain antennas 230 in MIMO configuration, such as a 1×1, 2×2, 3×3, 4×4, or another suitable MIMO configuration for communication with a wireless-enabled device using a in accordance with the communication standard used by the antenna configuration. The MIMO configuration may implement spatial multiplexing, diversity multiplexing, and/or other suitable technique of communication. Antenna control module 232 may maintain a MIMO antenna list to control which antenna (s) 230 are available for use in the MIMO configuration. In some embodiments, removing an antenna from the MIMO antenna list may result in the antenna transitioning to an inactive or off state, and adding an antenna to the MIMO antenna list may result in the antenna being available for use in the MIMO configuration.

In some embodiments, antenna control module 232 may detect environmental occurrences around portable information handling system 200 that necessitate updates to the antenna configuration. Antenna control module 232 may use one or more sensors (not shown) in information handling system 200 to detect an environmental change causing an undesirable state in the current antenna configuration. For example, antenna control module 232 may detect from a proximity sensor that a human body is in close proximity to a particular antenna 230. In such a scenario, it may be desirable to remove the antenna from the MIMO antenna list so that the antenna is transitioned to an inactive state, thus ensuring portable information handling system 200 complies with SAR requirements. Antenna control module 232 may also use the signal reception at one or more antennas 230 to detect environmental changes indicative that a particular antenna 230 has entered a suboptimal state. If, for example, lid 210 has been placed in close proximity to an obstruction (e.g., a wall, a body part, or another object affecting reception), one or more of the antennas in lid 210 (e.g., antennas 230-1, 230-2, 230-3, and 230-4) may experience a sudden degradation in signal reception, transmission, and/or gain, indicating an environmental change affecting one or more antennas. Antenna control module 232 may update the MIMO antenna list based one or more detected environmental occurrences around portable information handling system 200.

In certain embodiments, antenna control module 232 may detect changes in the physical configuration of portable information handling system 200 that necessitate updates to the antenna configuration. Particular physical configurations of portable information handling system 200 may result in a suboptimal or undesirable state for one or more antennas 230. For example, antenna 230 may be placed and/or oriented in a particular direction to optimize signal reception and/or transmission when portable information handling system 200 is in a particular physical configuration, such as laptop mode. However, as chassis 202 is articulated into different configurations (e.g., tablet stand, tent, or tablet mode), the placement and/or orientation of antenna 230 may also change, resulting degraded reception, transmission, and/or gain for antenna 230. Position of the chassis, such as the angle of lid 210 from base 220, may be detected by a sensor (e.g., an accelerometer, proximity sensor, gyroscope, magnetometer, button, switch, rotary switch, and/or any other appropriate sensor). Similarly, the placement and/or orientation of an antenna 230 may be selected to minimize interference between antenna 230 and one or more other antennas 230 for a particular physical configuration of portable information handling system 200. As chassis 202 moves, antenna 230 may also move, affecting the placement and/or orientation of antenna 230. The new placement and/or orientation of antenna 230 may cause increased interference between antenna 230 and one or more antennas 230, such that signals received and/or transmitted by the affected antennas 230 are degraded. For example, the main beam from antenna 230 may be directed away from other antennas 230 in one configuration, but in a second configuration the main beam may be directed at another antenna 230, thereby interfering with signals received from the wireless-enabled device. In addition, the placement and/or orientation of antennas 230 in a particular physical configuration may affect electromagnetic field radiation from the system, which in turn may necessitate updates to the antenna configuration to meet SAR requirements. Antenna control module 232 may update the MIMO antenna list based on the physical configuration of portable information handling system 200.

As described above, the environment surrounding and/or physical configuration of portable information handling system 200 may result in one or antennas 230 experiencing suboptimal states in which the reception, transmission, and/or gain are substantially degraded. Use of an antenna experiencing a suboptimal state may, in some circumstances, affect the overall communication of portable information handling system 200. Thus, antenna control module 232 may remove the affected antenna 230 from the MIMO antenna list and/or retrain the antennas in the MIMO configuration to account for the changed reception and/or transmission capacity of the affected antenna(s) 230. To control the frequency of updates to the MIMO configuration, in some embodiments, antenna control module 232 may require that the suboptimal or undesirable state persist for a predetermined amount of time before the MIMO antenna list is updated and/or retraining of the antennas is performed.

In some embodiments, antenna control module 232 may detect particular configurations of portable information handling system 200 that may affect the antenna configuration. For example, antenna control module 232 may detect that portable information handling system 200 has entered into a low power state, such that the number and/or types of antennas 230 in use should be changed to reduce overall power consumption. In some embodiments, antenna control module 232 may also detect that portable information handling system 200 is in low data usage mode based on, for example, a particular combination of programs currently in use and/or the current mode of information handling system 200 (e.g., laptop mode may represent a low data usage state for creating and editing documents, replying to emails). Upon detection of a data usage mode, antenna control module 232 may reduce and/or change the MIMO antenna list.

Figure 2B:
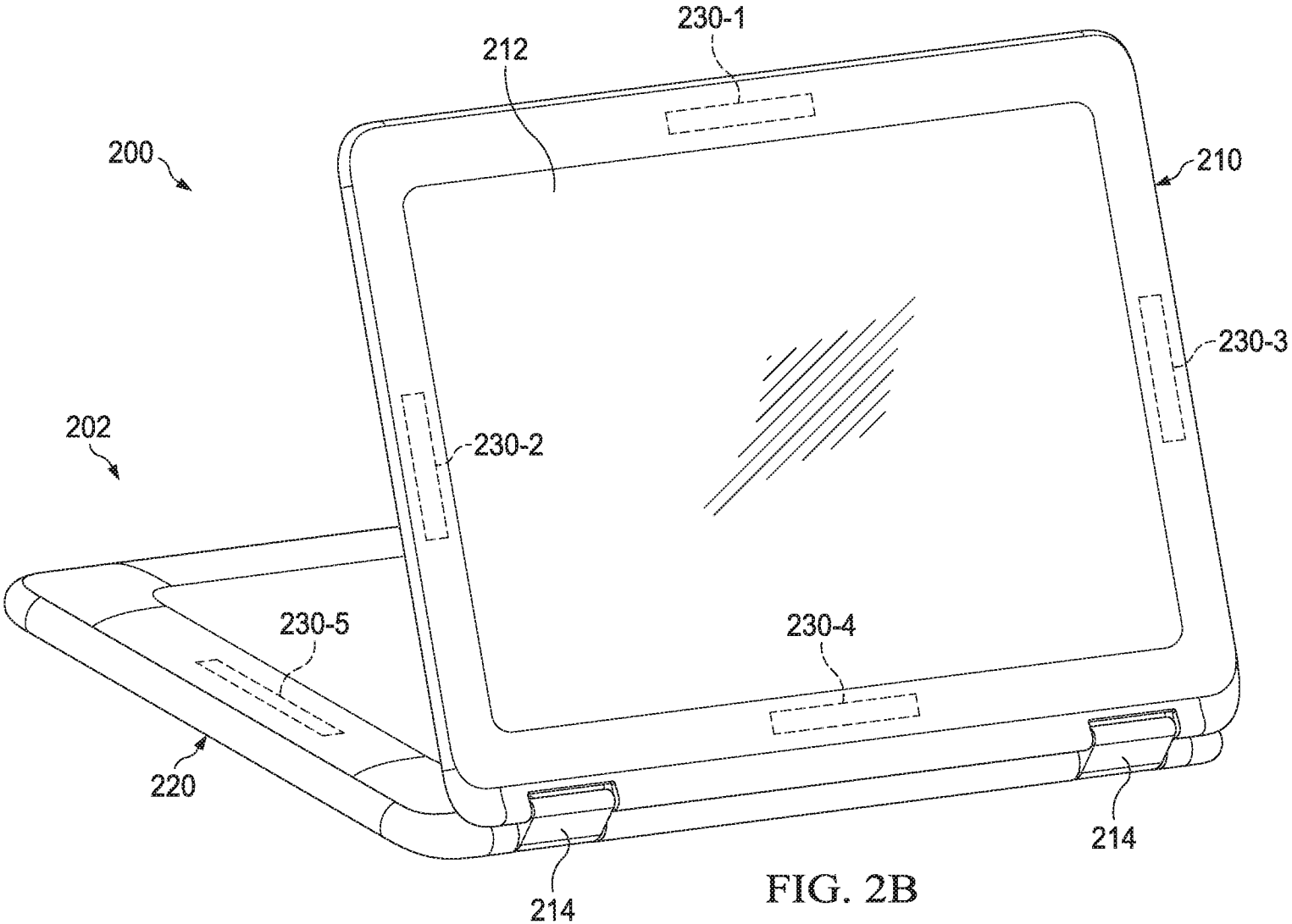
FIG. 2B illustrates a portable information handling system in tablet stand mode in accordance with some embodiments of the present disclosure.
Figure 2C:
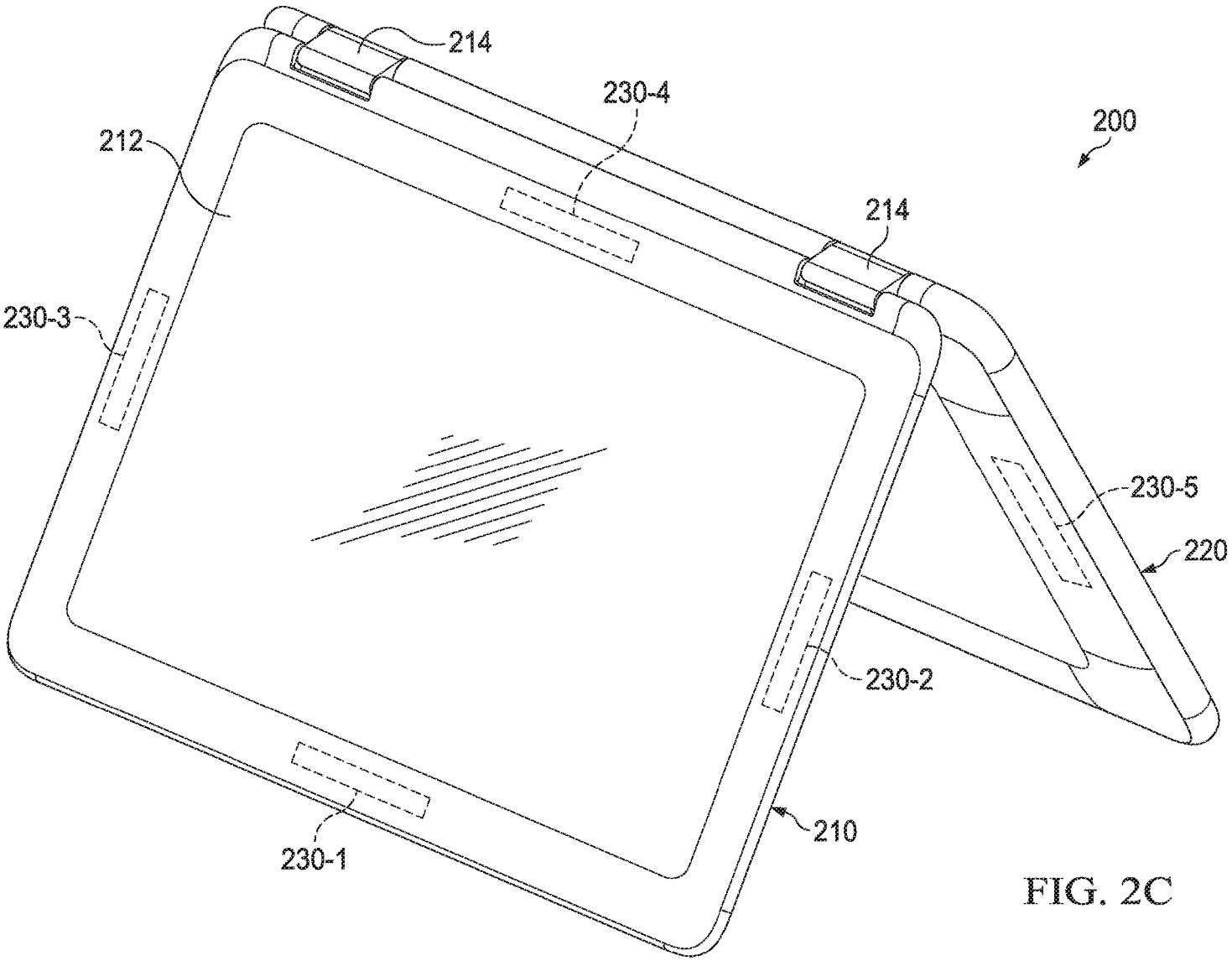
FIG. 2C illustrates a portable information handling system in tent mode in accordance with some embodiments of the present disclosure.

FIG. 2B illustrates a portable information handling system 200 in tablet stand mode, and FIG. 2C illustrates a portable information handling system 200 in tent mode. In tablet stand mode and tent mode, lid 210 and base 220 may be arranged in an open configuration, representing lid 210 opened from base 220 at an angle greater than 180 degrees as measured from the surface of touch panel 212 to keyboard 222. In tablet stand mode, base 220 may be placed on a flat surface (e.g., a table, desk, or user lap) with lid 210 angled toward the user so that touch panel 212 is visible. In tent mode, base 220 and lid 210 may form a tent as illustrated in FIG. 2C, such that touch panel 212 is visible to the user. Antenna control module 232 may detect the difference between tablet stand mode and tent mode based on one or more sensors (e.g., an accelerometer, proximity sensor, gyroscope, magnetometer, button, switch, and/or any other appropriate sensor). In some embodiments, tablet stand mode and tent mode may represent lid 210 open between approximately 225 and 315 degrees from base 220 as measured from the surface of touch panel 212 to keyboard 222. However, in certain embodiments, tablet stand and/or tent mode may represent lid 210 open in any amount between approximately 180 and 359 degrees from base 220 as measured from the surface of touch panel 212 to keyboard 222. In tablet stand mode and/or tent mode, a user may provide input to portable information handling system 200 via touch panel 212 and/or another I/O component not illustrated. Output from portable information handling system 200 may be displayed via touch panel 212.

As discussed above, antenna control module 232 may consider the physical configuration of and environment surrounding portable information handling system 200 in selecting the MIMO antenna list and configuring the MIMO configuration. For example, antenna control module 232 may determine from the physical relation of lid 210 to base 220 that certain antennas 230 may be placed in suboptimal locations and/or orientations, cause undesired interference with other antennas, and/or cause SAR related issues based on the configuration of chassis 202. Likewise, the environment surrounding portable information handling system 200 may affect antennas 230. For example, in tablet stand mode illustrated in FIG. 2B, one or more of antennas 230 located in base 220 (e.g., antennas 230-5, 203-6, and 203-7) may experience degraded performance depending on, for example, the material upon which base 220 is sitting, and/or the orientation or type of antennas 230. Similarly, in tent mode illustrated in FIG. 2C, antennas 230 located near the top of lid 210 (e.g., antenna 230-1) or the bottom of base 220 may experience suboptimal performance depending on the material upon which the tent is balanced and/or the orientation or type of antennas 230. In such scenarios, antenna control module 232 may adjust the MIMO antenna list and/or retrain the MIMO configuration to account for changed circumstances.

In some embodiments, antenna control module 232 may adjust the MIMO antenna list based on other configurations of the portable information handling system 200. For example, tablet stand mode and/or tent mode may represent a high data usage configuration. In tablet stand and/or tent mode, a user may play games, video conference, and/or stream video or audio from the Internet using portable information handling system 200. In response to portable information handling system 200 entering a high data usage mode, antenna control module 232 may add one or more antennas 230 to the MIMO antenna list, select higher throughput antennas 230 for the MIMO antenna list, and/or request MIMO configuration increase throughput (e.g., by transitioning from a 3×3→2×2 MIMO configuration) if available. In some embodiments, antenna control module 232 may monitor other factors (e.g., current power state, actual data usage demand, programs currently in use, and/or the environment surrounding portable information handling system 200) to determine what if any updates to antenna configuration are desirable.

Figure 2D:
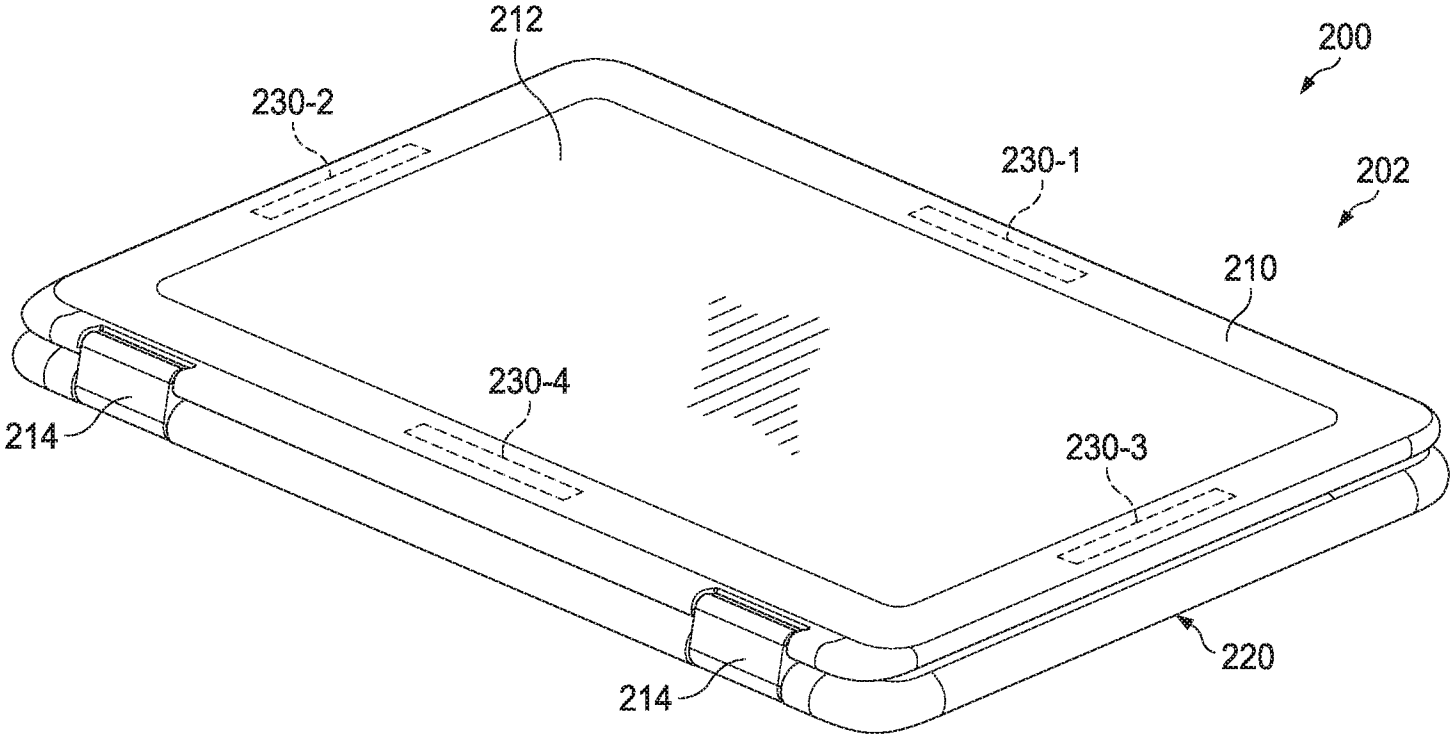
FIG. 2D illustrates a portable information handling system in tablet mode in accordance with some embodiments of the present disclosure.

FIG. 2D illustrates a portable information handling system 200 in tablet mode. In tablet mode, lid 210 and base 220 may be arranged in a fully open configuration, representing lid 210 opened from base 220 at an angle of approximately 360 degrees. In tablet mode, base 220 may be placed on a flat surface (e.g., a table, desk, or lap) or held by the user in a comfortable position. In tablet mode, a user may provide input to information handling system 220 via touch panel 212 and/or another I/O component not illustrated. Output from portable information handling system 200 may be displayed via touch panel 212.

As discussed above, antenna control module 232 may also consider the physical configuration of and/or environment surrounding information handling system 200 in selecting the MIMO antenna list. To illustrate, antenna control module 232 may determine from the physical relation of lid 210 to base 220 that certain antennas 230 may experience suboptimal performance and/or cause undesired interference other antennas. For example, in tablet mode, antennas 230 in lid 210 and base 220 may be directly next to each other (e.g., antenna 230-4 and 230-7, antenna 230-2 and 230-5, antenna 230-3 and 230-6 may be next to each other in tablet mode). Thus, antennas 230 placed and/or oriented for optimal reception and/or transmission performance in laptop mode may now experience suboptimal performance in tablet mode. As discussed above, antenna 230-1 may be placed and/oriented such that the main beam is directed away from touch panel 212, optimizing signal reception and/or transmission in laptop mode. In tablet mode, however, the main beam from antenna 230-1 may now be oriented directly into base 220, thereby limiting the performance of antenna 230-1. Similarly, the placement and/or orientation of antenna 230-1 in tablet mode may cause interference with other antennas 230 that was not present in another mode (e.g., laptop, stand, or tent mode). Performance and interference of antennas 230 may depend on other factors, including but not limited to the material of the chassis, orientation and/or type of antennas 230, and/or the environment around the system as discussed below. In some embodiments, antenna control module 232 may determine from the physical relation of lid 210 to base 220 that certain antennas 230 may cause SAR related issues based on the physical configuration of chassis 202. For example, antenna control module 232 may detect that two or more antennas 230 are now in close proximity to each other and/or aligned in orientation in such a way that results in increased electromagnetic field radiation in a particular direction. In detecting potential SAR issues, antenna control module 232 may account for how a user may hold or interact with chassis 202 in the present configuration. For example, in tablet mode, a user may hold portable information handling system 200 by an edge of chassis 202 as opposed to resting their hands on the keyboard in laptop mode. Antenna control module 232 may, based on one or more sensors, detect which edge is being held and in turn update the MIMO antenna list in order to avoid degraded antenna performance and/or comply with SAR requirements.

In some embodiments, antenna control module 232 may adjust the MIMO antenna list based on other configurations of the portable information handling system 200. For example, tablet mode may represent a low data usage configuration of portable information handling system 200.

In tablet mode, a user may edit documents, swipe through photos, or browse the Internet. As explained above, antenna control module 232 may detect that portable information handling system 200 has entered into a low data usage mode (e.g., tablet mode) based on one or more sensors. In response, antenna control module 232 may update the MIMO antenna list. In some embodiments, antenna control module 232 may monitor other factors (e.g., current power state, actual data usage demand, programs currently in use, and/or the environment surrounding information handling system 200) in determining what if any updates to antenna configuration are desirable.

As discussed with respect to FIG. 1 above, the antenna control module may retrain the antennas of the MIMO configuration. In some embodiments, the particular manner of antenna retraining may depend on the particular communications standard being used for communication. In some embodiments, retraining may involve a MIMO algorithm sending and/or receiving data (e.g., training signals or other data) between antennas 232 and transmitters with which the antennas are paired. By detecting the strength and/or delay of the data at different antennas 232 and transmitters, the MIMO algorithm may be able to determine the optimal configuration (e.g., the appropriate number of antennas and transmitters to use, such as 1×1, 2×2, 3×3, or 4×4 MIMO), and the particular settings (e.g., the appropriate signals, delays to apply to the signals, and/or strength of the signals to transmit on the different paths) of the one or more communication paths between the antennas and transmitters. In some embodiments, antenna control module 232 may retrain one or more antennas 230 upon an update to the MIMO antenna list. In certain embodiments, antenna control module 232 may retrain one or more antennas 230 without updating to the MIMO antenna list. For example, upon detecting a change to the configuration of and/or environment surrounding portable information handling system 200, antenna control module 232 may retrain one or more antennas 230 to ensure optimal communication with the MIMO configuration. Similarly, in some embodiments, antenna control module 232 may retrain one or more antennas 230 periodically, after a predetermined amount of time (e.g., 5 minutes) elapses to ensure to ensure optimal communication with the MIMO configuration.

Although an exemplary 2-in-1 tablet-laptop system was illustrated and discussed in FIGS. 2A-D, embodiments of the present invention may include any type of information handling system. For example, the information handling system may be a laptop, smart phone, tablet computer, notebook computer, media player, digital camera, wireless organizers, or any other information handling system capable of wireless communication. The chassis of the information handling system may be any suitable shape, form, or configuration. For example, in some embodiments, the information handling system may include a malleable chassis with flexible organic light emitting diode capable of folding and arranging in many different positions.

FIG. 3 illustrates an example method 300 for antenna optimization, in accordance with some embodiments of the present disclosure. Method 300 may begin at step 302, where available antenna resources are determined. In some embodiments, the information handling system may determine what antennas are available for wireless communication in a MIMO configuration. In certain embodiments, the available antennas may represent antennas listed in a MIMO antenna list maintained by an antenna control module of the information handling system, as discussed with respect with FIGS. 1 and 2.

In step 304, method 300 configures the MIMO antenna configuration for the information handling system. In some embodiments, configuration may involve determining what type of communications protocol to use for wireless communications (e.g., IEEE 802.11n, 802.11ac, evolved high-speed packet access, worldwide interoperability for microwave access, and/or long term evolution). In certain embodiments, configuration may involve determining the optimal MIMO configuration (e.g., the appropriate number of antennas and transmitters to use, such as 1×1, 2×2, 3×3, or 4×4 MIMO), and/or the particular settings (e.g., the appropriate signals, delays to apply to the signals, and/or strength of the signals to transmit on the different paths, collectively sometimes referred to as the antenna training) of the one or more communication paths between the antennas and transmitters in the MIMO configuration. In certain embodiments, step 304 may be performed by the antenna control module of the information handling system.

In step 306, method 300 may determine whether a MIMO antenna configuration update is required. In some embodiments, updates to the MIMO antenna configuration may be required upon detection of changes to the physical configuration and/or environment of the information handling system as discussed above with respect to FIGS. 1 and 2. In certain embodiments, updates to the MIMO antenna configuration may be made to account for other aspects of information handling system, such as the power state, data usage, and/or programs in use. In certain embodiments, updates to the MIMO antenna configuration may be appropriate after the expiration of a predetermined time interval, regardless of whether configuration or environmental changes were detected. If no updates are required, then method 300 may remain at step 306 until such an update is required.

If, however, a MIMO antenna configuration update is required, then method 300 may proceed to step 308. At step 308, the information handling system may update the MIMO antenna list by, for example, adding and/or removing one or more antennas. In certain embodiments, the information handling system may retrain one or more of the antennas as discussed above with respect to FIGS. 1 and 2 in order to ensure optimal performance of the various communication paths comprising the MIMO configuration.

Method 300 may be implemented in any suitable manner. It is noted that certain steps or operations described in method 300 may be optional or may be rearranged in different embodiments.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, features, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A portable information handling system, comprising:

a chassis;

a plurality of physical antennas coupled to the chassis, the plurality of physical antennas configured to communicate in a multiple-input and multiple-output (MIMO) antenna configuration that implements at least one of one of a spatial multiplexing and a diversity multiplexing and configured to communicate with a wireless-enabled device; and an antenna control module communicatively coupled to the plurality of physical antennas, the antenna control module configured to:

detect a change in at least one of a physical configuration of the chassis and an environment surrounding the portable information handling system, the change affecting a performance of one or more of the plurality of physical antennas;

determine an interference between at least a first antenna and a second antenna of the one or more of the plurality of physical antennas based on the change of the physical configuration of the chassis, wherein a first position of the first antenna has changed relative to a second position of the second physical antenna; and based on the change and the interference, update a MIMO antenna list from the plurality of physical antennas, the MIMO antenna list representing active physical antennas for communicating with the wireless-enabled device, wherein the antenna control module comprising a device.

2. The system of claim 1, wherein a sensor communicatively coupled to the antenna control module and configured to communicate the change of the physical configuration of the chassis to the antenna control module.

3. The system of claim 2, wherein the sensor is further configured to communicate, to the antenna control module, a change in an angle of a lid relative to a base of the chassis.

4. The system of claim 1, wherein the physical configuration of the chassis includes an angle of a lid relative to a base of the chassis.

5. The system of claim 1, wherein, to detect a change in the environment surrounding the portable information handling system, the antenna control module is further configured to determine a degradation in the performance of the one or more of the plurality of physical antennas based on an object in proximity to the chassis.

6. The system of claim 1, wherein, to detect a change in the environment surrounding the portable information handling system, the antenna control module is further configured to receive a signal from a sensor, the sensor configured to detect an object in proximity to the chassis.

7. The system of claim 1, wherein the antenna control module is further configured to retrain antennas in the MIMO antenna list after updating the MIMO antenna list.

8. The system of claim 1, wherein the antenna control module is further configured to account for a power and a data usage of the portable information handling system in updating the MIMO antenna list.

9. The system of claim 1, wherein, to update the MIMO antenna list, the antenna control module is further configured to remove an antenna from the MIMO antenna list so the antenna is placed in an inactive state.

10. The system of claim 1, wherein, to update the MIMO antenna list, the antenna control module is further configured to add an antenna from the MIMO antenna list so the antenna is placed in an active state.

11. A method of antenna optimization comprising:

detecting a change in at least one of a physical configuration of a chassis of a portable information handling system and an environment surrounding the portable information handling system, the change affecting a performance of one or more of a plurality of physical antennas configured to communicate in a multiple-input and multiple-output (MIMO) antenna configuration that implements at least one of one of a spatial multiplexing and a diversity multiplexing and configured to communicate with a wireless-enabled device, wherein the one or more of the plurality of physical antennas are coupled to the chassis;

determining an interference between at least a first antenna and a second antenna of the one or more of the plurality of physical antennas based on the change of the physical configuration of the chassis, wherein a first position of the first antenna has changed relative to a second position of the second antenna; and based on the change and the interference, updating a MIMO antenna list from the plurality of physical antennas, the MIMO antenna list representing active physical antennas for communicating with the wireless-enabled device.

12. The method of claim 11, further comprising a sensor communicating the change of the physical configuration of the chassis.

13. The method of claim 12, further comprising the sensor communicating a change in an angle of a lid relative to a base of the chassis.

14. The method of claim 11, wherein the physical configuration of the chassis includes an angle of a lid relative to a base of the chassis.

15. The method of claim 11, wherein the detecting the change in the environment surrounding the portable information handling system includes determining a degradation in the performance of the one or more of the plurality of physical antennas based on an object in proximity to the chassis.

16. The method of claim 11, wherein the detecting the change in the environment surrounding the portable information handling system includes receiving a signal from a sensor, the sensor detecting an object in proximity to the chassis.

17. The method of claim 11, further comprising retraining antennas in the MIMO antenna list after updating the MIMO antenna list.

18. The method of claim 11, further comprising accounting for a power and a data usage of the portable information handling system in updating the MIMO antenna list.

19. The method of claim 11, wherein the updating the MIMO antenna list includes removing an antenna from the MIMO antenna list so the antenna is placed in an inactive state.

20. The method of claim 11, wherein the updating the MIMO antenna list includes adding an antenna from the MIMO antenna list so the antenna is placed in an active state.

21. A non-transitory computer-readable medium storing instructions, that, when executed by a processor of a portable information handling system, cause the portable information handling system to:

detect a change in at least one of a physical configuration of a chassis of the portable information handling system and an environment surrounding the portable information handling system, the change affecting a performance of one or more of a plurality of physical antennas configured to communicate in a multiple-input and multiple-output (MIMO) antenna configuration that implements at least one of one of a spatial multiplexing and a diversity multiplexing and configured to communicate with a wireless-enabled device, wherein the one or more of the plurality of physical antennas are coupled to the chassis;

determine an interference between at least a first antenna and a second antenna of the one or more of the plurality of physical antennas based on the change of the physical configuration of the chassis, wherein a first position of the first antenna has changed relative to a second position of the second antenna; and based on the change and the interference, update a MIMO antenna list from the plurality of physical antennas, the MIMO antenna list representing active physical antennas for communicating with the wireless-enabled device.

22. The medium of claim 21, wherein the instructions further cause the portable information handling system to receive, from a sensor, a communication of the change of the physical configuration of the chassis.

23. The medium of claim 22, wherein the communication of the change includes a change in an angle of a lid relative to a base of the chassis.

24. The medium of claim 21, wherein the physical configuration of the chassis includes an angle of a lid relative to a base of the chassis.

25. The medium of claim 21, wherein, to detect the change in the environment surrounding the portable information handling system, the instructions further cause the portable information handling system to determine a degradation in the performance of the one or more of the plurality of physical antennas based on an object in proximity to the chassis.

26. The medium of claim 21, wherein, to detect the change in the environment surrounding the portable information handling system, the instructions further cause the portable information handling system to receive a signal from a sensor, the sensor configured to detect an object in proximity to the chassis.

27. The medium of claim 21, wherein the instructions further cause the portable information handling system to retrain antennas in the MIMO antenna list after updating the MIMO antenna list.

28. The medium of claim 21, wherein the instructions further cause the portable information handling system to account for a power and a data usage of the portable information handling system in updating the MIMO antenna list.

29. The medium of claim 21, wherein, to update the MIMO antenna list, the instructions further cause the portable information handling system to remove an antenna from the MIMO antenna list so the antenna is placed in an inactive state.

30. The medium of claim 21, wherein, to update the MIMO antenna list, the instructions further cause the portable information handling system to add an antenna from the MIMO antenna list so the antenna is placed in an active state.

* * * * *